US007681621B2

(12) United States Patent
Manser

(10) Patent No.: US 7,681,621 B2
(45) Date of Patent: Mar. 23, 2010

(54) PINCH FREE PANEL SYSTEM AND METHOD

(75) Inventor: Ian J Manser, Orlando, FL (US)

(73) Assignee: Metecno Panel Systems, Inc., Deland, FL (US)

( * ) Notice: Subject to any disclaimer, the term of this patent is extended or adjusted under 35 U.S.C. 154(b) by 403 days.

(21) Appl. No.: 11/174,184

(22) Filed: Jul. 1, 2005

(65) Prior Publication Data

US 2007/0000623 A1 Jan. 4, 2007

(51) Int. Cl.
*E06B 3/48* (2006.01)

(52) U.S. Cl. ..... 160/229.1; 160/201; 160/40

(58) Field of Classification Search ..... 160/229.1, 160/236, 235, 232, 231.2, 40, 201; 49/498.1, 49/489.1, 495.1
See application file for complete search history.

(56) References Cited

U.S. PATENT DOCUMENTS

| | | | | |
|---|---|---|---|---|
| 1,603,379 | A | 10/1926 | Dautrick | |
| 1,630,680 | A | 5/1927 | Twedt et al. | |
| 2,134,397 | A | 10/1938 | Clark | |
| 2,252,737 | A | 8/1941 | Siess | |
| 2,263,995 | A | 11/1941 | Katulski | |
| 2,300,265 | A | 10/1942 | Siess | |
| 2,549,301 | A | 4/1951 | Ferrell et al. | |
| 2,871,932 | A | 2/1959 | Stroup | |
| 2,892,494 | A | 6/1959 | Stroup | |
| 2,951,533 | A | 9/1960 | Lucas et al. | |
| 3,103,967 | A | 9/1963 | Gaschen | |
| 3,118,702 | A | 1/1964 | Kale et al. | |
| 3,148,724 | A | 9/1964 | Chieger et al. | |
| 3,198,242 | A | 8/1965 | Crosswell | |
| 3,302,690 | A | 2/1967 | Hurd | |
| 3,302,692 | A | 2/1967 | Grau | |
| 3,319,697 | A | 5/1967 | Krohn | |
| 3,326,268 | A * | 6/1967 | Dixon | 160/231.2 |
| 3,334,681 | A | 8/1967 | Crosswell | |
| 3,347,305 | A | 10/1967 | Urbanick | |
| 3,424,222 | A | 1/1969 | Stoner et al. | |
| 3,891,021 | A | 6/1975 | Geoffrey | |

(Continued)

FOREIGN PATENT DOCUMENTS

| | | |
|---|---|---|
| AT | 369126 | 12/1982 |

(Continued)

*Primary Examiner*—Blair M. Johnson
(74) *Attorney, Agent, or Firm*—Harness, Dickey & Pierce, P.L.C.

(57) ABSTRACT

An articulating door generally includes a first door panel having a bottom section, the bottom section defining a first bottom portion, a second bottom portion and a first bottom channel therebetween. A second door panel is coupled for rotation with the first door panel. The first door panel and the second door panel moving between an open condition and a closed condition. The second door panel has a top section proximate the bottom section of the first door panel. The articulating door also includes a blocking member having a ramp portion. The blocking member extends from the top section of the second door panel. At least a portion of the blocking member is received by the first bottom channel of the first door panel in the closed condition. The ramp member is disposed between the first bottom portion of the first door panel and the top section of the second door panel.

18 Claims, 9 Drawing Sheets

U.S. PATENT DOCUMENTS

| | | | | | |
|---|---|---|---|---|---|
| 3,941,180 | A | | 3/1976 | Thill | |
| 3,967,671 | A | | 7/1976 | Stanley et al. | |
| 4,269,253 | A | | 5/1981 | Ziegler | |
| 4,518,026 | A | | 5/1985 | Otto et al. | |
| 4,736,785 | A | | 4/1988 | Seuster | |
| 4,771,816 | A | * | 9/1988 | Clay, Jr. | 160/235 |
| 4,854,365 | A | | 8/1989 | Juneau | |
| 4,893,666 | A | | 1/1990 | Hormann | |
| 4,924,932 | A | | 5/1990 | Esnault | |
| 4,989,660 | A | | 2/1991 | Wagner | |
| 4,995,441 | A | | 2/1991 | Leist et al. | |
| 5,002,114 | A | | 3/1991 | Hormann | |
| 5,129,441 | A | | 7/1992 | Leist et al. | |
| 5,133,108 | A | * | 7/1992 | Esnault | 16/225 |
| 5,148,850 | A | | 9/1992 | Urbanick | |
| 5,170,832 | A | | 12/1992 | Wagner | |
| 5,419,386 | A | | 5/1995 | Magro et al. | |
| 5,448,865 | A | | 9/1995 | Palmersten | |
| 5,502,939 | A | | 4/1996 | Zadok et al. | |
| 5,564,164 | A | | 10/1996 | Jella | |
| 5,669,431 | A | * | 9/1997 | Druzynski et al. | 160/229.1 |
| 6,098,697 | A | * | 8/2000 | Krupke et al. | 160/229.1 |
| 6,578,619 | B2 | * | 6/2003 | Wright | 160/229.1 |
| 6,626,226 | B2 | | 9/2003 | Whitley | |
| 6,648,052 | B2 | | 11/2003 | Marzari Chiesa et al. | |
| 2002/0179256 | A1 | * | 12/2002 | Leist et al. | 160/201 |
| 2004/0182036 | A1 | | 9/2004 | Sjoberg et al. | |

FOREIGN PATENT DOCUMENTS

| | | | |
|---|---|---|---|
| AT | 378237 | | 7/1985 |
| AT | 382423 | | 2/1987 |
| CH | 297311 | | 3/1954 |
| DE | 1509191 | | 7/1969 |
| DE | 2106063 | | 8/1971 |
| DE | 2103820 | | 9/1971 |
| DE | 2903745 | | 8/1980 |
| DE | 87078236 | | 9/1987 |
| DE | 3816985 | A1 | 11/1989 |
| DE | 3726699 | C2 | 5/1994 |
| FR | 1310605 | | 10/1962 |
| FR | 1396317 | | 3/1965 |
| FR | 1555410 | | 12/1968 |
| FR | 2220659 | | 10/1979 |
| GB | 516770 | | 1/1940 |

* cited by examiner

PINCH FREE PANEL SYSTEM AND METHOD

CROSS-REFERENCE TO A RELATED DISCLOSURE

This application is based on commonly assigned U.S. Pat. No. 5,669,431, entitled Garage Door Panel, issued Sep. 2, 1997. The above disclosure is hereby incorporated by reference as if fully set forth herein.

FIELD

The present teachings relate to garage or overhead doors and more particularly relate to a pinch free panel.

BACKGROUND

Overhead or garage doors are utilized in all types of residential and commercial applications to close off various building openings. Also, these types of doors are utilized in over-the-road trucks. Typically, the doors include horizontal panels which are hinged together and move vertically with respect to the opening. The panels include rollers at their ends, which move in tracks. In addition, springs or elastic members may be coupled to the panels. The rollers and the spring may assist in vertical movement.

As the doors move vertically, the panels articulate with respect to one another typically creating an opening between two adjacent panels about a hinge. The opening increases in size as the panels further articulate about one another. As the opening size increases, the propensity of the opening to receive foreign objects or debris increases. Moreover, exposure of the hinge increases as the opening size increases.

SUMMARY

The present teachings generally include an articulating door that includes a first door panel having a bottom section, the bottom section defining a first bottom portion, a second bottom portion and a first bottom channel therebetween. A second door panel is coupled for rotation with the first door panel. The first door panel and the second door panel moving between an open condition and a closed condition. The second door panel has a top section proximate the bottom section of the first door panel. The articulating door also includes a blocking member having a ramp portion. The blocking member extends from the top section of the second door panel. At least a portion of the blocking member is received by the first bottom channel of the first door panel in the closed condition. The ramp member is disposed between the first bottom portion of the first door panel and the top section of the second door panel.

Further areas of applicability of the present teachings will become apparent from the detailed description provided hereinafter. It should be understood that the detailed description and specific examples, while indicating the various embodiments of the present teachings, are intended for purposes of illustration only and are not intended to limit the scope of the teachings.

BRIEF DESCRIPTION OF THE DRAWINGS

The present invention will become more fully understood from the detailed description, the appended claims and the accompanying drawings, wherein:

DETAILED DESCRIPTION

The following description of the various embodiments is merely exemplary in nature and is in no way intended to limit the invention, its application, or uses.

Figure 1:
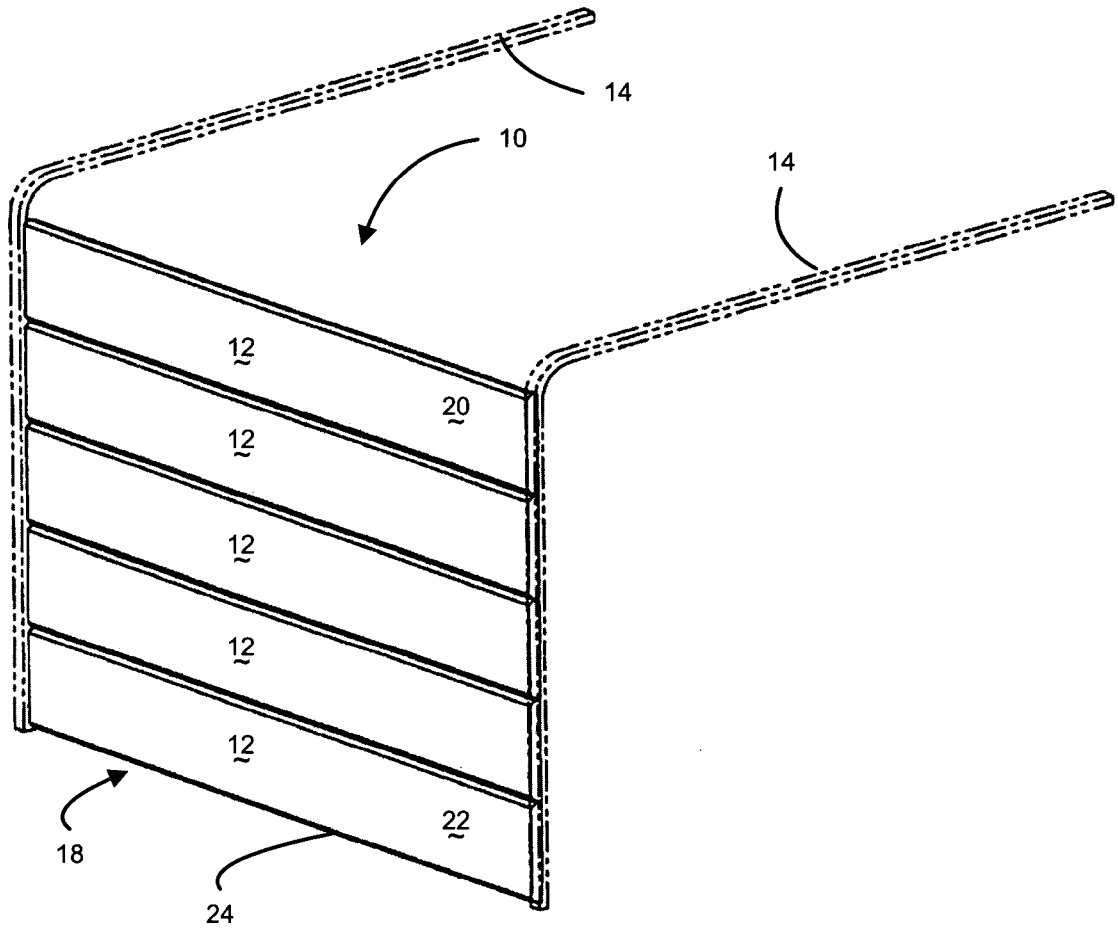
FIG. 1 is a perspective view of an overhead door in accordance with the present teachings.

With reference to FIG. 1, an overhead door 10 generally includes a plurality of horizontally extending panels 12, which may move (e.g., up and down) via rollers (not shown) in rails 14. The overhead door 10 may be utilized as a residential or commercial type of garage door, a tractor trailer door and in other suitable installations.

Figure 2:
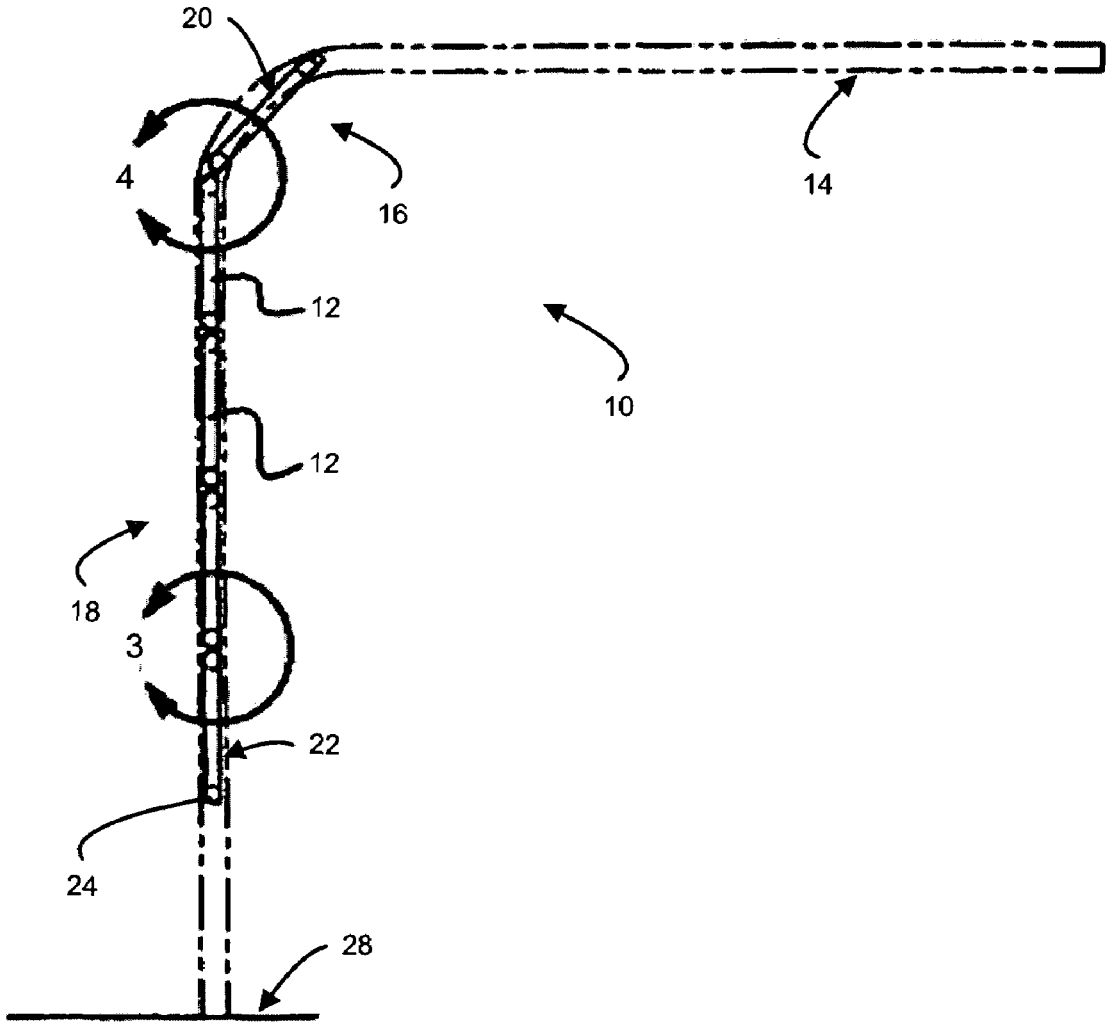
FIG. 2 is a side elevation view of the door of FIG. 1 in a partially retracted position.

With reference to FIGS. 1 and 2, the overhead door 10 is illustrated in a partially open, articulated or retracted position 16. As such, a portion of the panels 12 is also illustrated in a stacked or closed position 18. In one example, the panels 12 are identical. In another example, a top panel 20 and/or a bottom panel 22 may have a flat or straight edge 24. The panels 12 may have a blocking member 26 (FIGS. 3-6) that seals the adjacent panels 12 to each other. The blocking member 26 may also prevent pinching between the panels 12. The flat or straight edge 24 on the top panel 20 and/or the bottom panel 22 may have a weather strip (not shown) integral to the edge 24 or in addition thereto. It will be appreciated that other suitable seals may be used between the panels 12 and/or between the overhead door 10 and the ground 28 and/or a deck of other structures.

Figure 3:
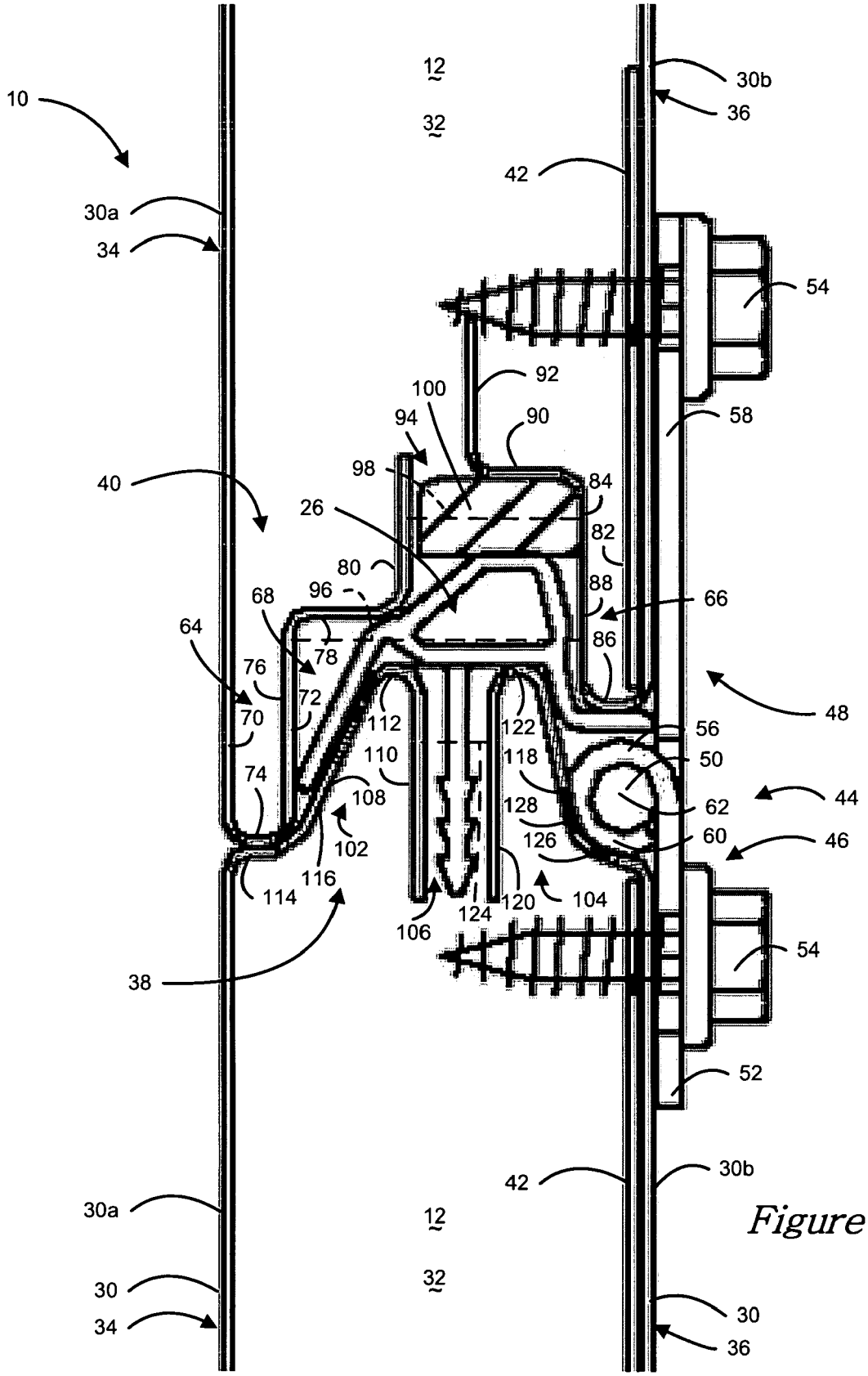
FIG. 3 is a cross-section view of FIG. 2 within circle 3.
Figure 4:
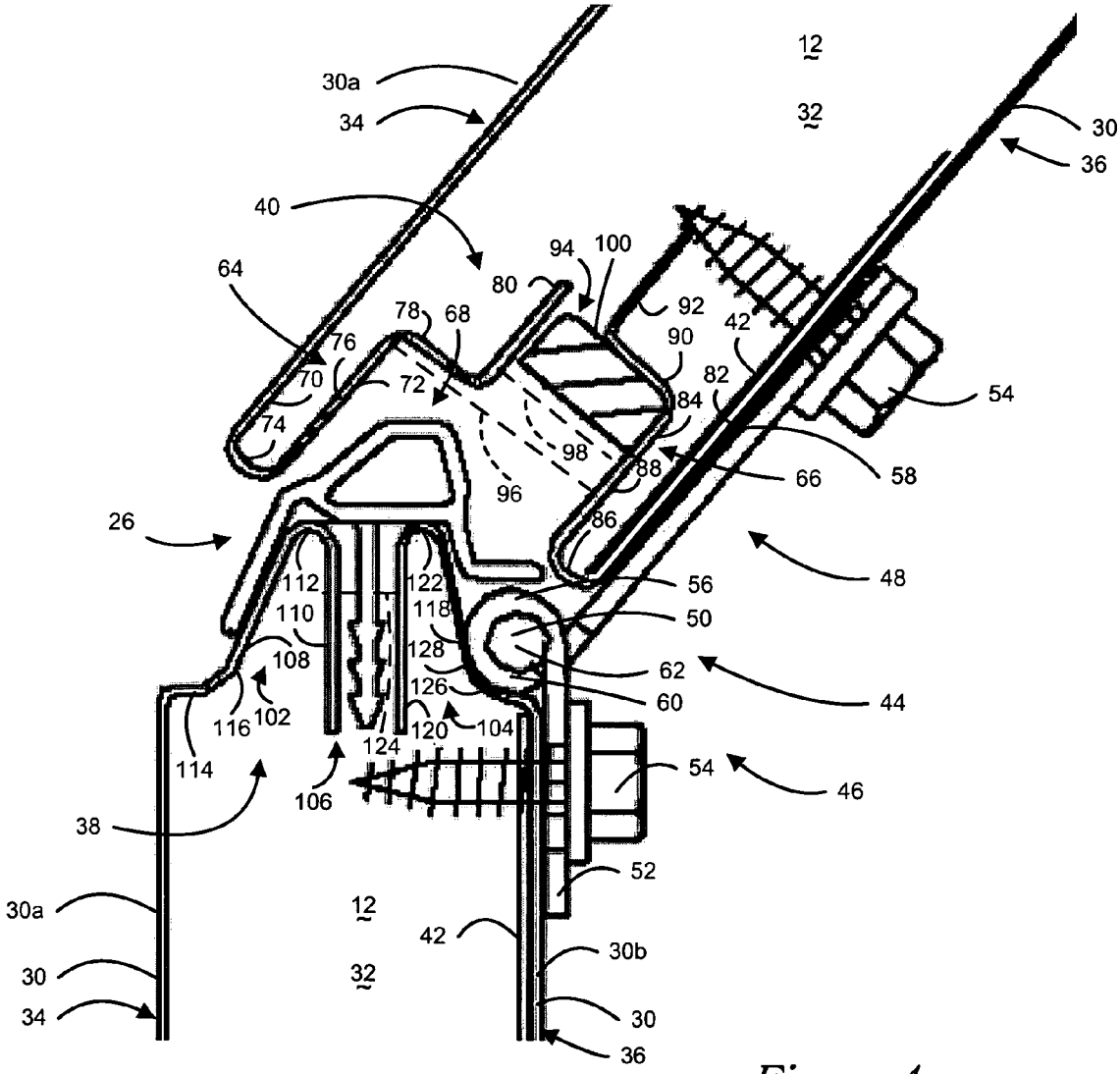
FIG. 4 is similar to FIG. 3 and shows a cross-section view of FIG. 2 within circle 4 of FIG. 2 in an open position.

In one example and with reference to FIGS. 3 and 4, each of the panels 12 includes an outer skin 30 with an inner material 32 contained within the outer skin 30. It will be appreciated that the outer skin 30 and/or various portions of the overhead door 10 may be made of metal, plastic, organic materials (e.g., wood or a wood veneer) and/or combinations thereof. The inner material 32 may serve as an insulating material as well as a structure to which a front skin **30*a* and a rear skin 30*b* (collectively referred to as the outer skin 30) may couple, thus defining a front panel 34 and a rear panel 36. The panels 34 and 36 further define a first or top section 38 (i.e., the top of the panel 12) as well as a second or bottom section 40 (i.e., the bottom of the panel 12). In one example, the panels 34 and 36 may be generally planar and/or parallel to one another. In another example, a reinforcement plate 42 may connect to the outer skin 30. In the various examples, the outer skin 30 may be stamped, extruded or formed by various suitable processes and made in one or more pieces. It will be appreciated that the panels 12** may constructed one or more various materials and may be a unitary construction or an assembly of parts.

A hinge 44 couples the adjacent panels 12 for rotation or articulation with respect to another panel 12. The hinge 44 includes a first hinge member 46, a second hinge member 48, and a pin 50 that secures the hinge members 46, 48 together. The first hinge member 46 includes a planar portion 52, which is secured to the rear panel 36 of the panel 12 with suitable fasteners 54. The first hinge member 46 also includes a cylindrical or barrel portion 56, which may receive the pin 50. Likewise, the second hinge member 48 includes a planar portion 58 that secures to the rear panel 36 of the adjacent panel 12 with the fasteners 54. It will be appreciated that the fasteners 54 may further couple to the reinforcement plate 42 that may be disposed between the inner material 32 and the outer skin 30. The second hinge member 48 also includes a complementary cylindrical or barrel portion 60, which couples with the cylindrical or barrel portion 56 and the pin 50 in a manner known in the art. The pin 50 includes a center or axis point 62, about which the hinge members 46 and 48 rotate.

The bottom section 40 of the panel 12 includes a first bottom portion 64, a second bottom portion 66 and a first bottom channel 68 formed between the first bottom portion 64 and the second bottom portion 66. The first bottom portion 64 has a first wall 70, a second wall 72 and a rounded tip 74 formed between the first wall 70 and the second wall 72. In one example, the first wall 70 is a continuation of the front panel 34 of the panel 12. By way of the above example, the rounded tip 74 and the second wall 72 are contiguous with the first wall 70. In one example, the second wall 72 may include a first section 76, a second section 78 and a third section 80. The first section 76 and the third section 80 may be parallel to the first wall 70, while the second section 78 may be perpendicular to the first wall 70 of the first bottom portion 64.

The second bottom portion 66 includes a first wall 82, a second wall 84 and a rounded tip 86 formed between the first wall 82 and the second wall 84. In one example, the first wall 82 is a continuation of the rear panel 36 of the panel 12. By way of the above example, the rounded tip 86 and the second wall 84 are contiguous with the first wall 82. In one example, the second wall 84 may include a first section 88, a second section 90 and a third section 92. The first section 88 and the third section 92 may be parallel to the first wall 82, while the second section 90 may be perpendicular to the first wall 82 of the second bottom portion 66.

In one example, the first section 76 of the second wall 72 of the first bottom portion 64 and the first section 88 of the second wall 84 of the second bottom portion 66 define the first bottom channel 68. Moreover, the third section 80 of the second wall 72 of the first bottom portion 64 and the first section 88 of the second wall 84 of the second bottom portion 66 define a second bottom channel 94. In one example, the second bottom channel 94 is narrower than the first bottom channel 68. More specifically, a first dimension 96 (shown in broken line) defining a distance between the first section 76 and the first section 88 is greater than a second dimension 98 (shown in broken line) defining a distance between the third section 76 and the first section 88. In one example, a seal block 100 is received in the second bottom channel 94. By way of the above example, the seal block 100 may connect to a portion of the first section 88 and the second section 90 of the second wall 84 of the second bottom portion 66. The seal block 100 may also connect with the third section 80 of the second wall 72.

The top section 38 of the panel 12 includes a first top portion 102, a second top portion 104 and a top channel 106 formed between the first top portion 102 and the second top portion 104. The first top portion 102 has a first wall 108, a second wall 110 and a rounded tip 112 formed between the first wall 108 and the second wall 110. In one example, the first wall 108 is a continuation of the front panel 34 of the panel 12. By way of the above example, the rounded tip 112 and the second wall 110 are contiguous with the first wall 108.

A portion of the first wall 108 may be offset from the front panel 34. More specifically, the first wall 108 may have a first section 114 and a second section 116. The first section 114 connects the front panel 34 and the second section 116 and the first section 114 is about perpendicular to the front panel 34. The second section 116 connects the first section 114 and the rounded tip 112 and the second section 116 is slanted or extends diagonally relative to the front panel 34.

The second top portion 104 includes a first wall 118, a second wall 120 and a rounded tip 122 formed between the first wall 118 and the second wall 120. In one example, the first wall 118 is a continuation of the rear panel 36 of the panel 12. By way of the above example, the rounded tip 122 and the second wall 120 are contiguous with the first wall 118. In one example, the second wall 110 of the first top portion 102 and the second wall 120 of the second top portion 104 define the top channel 106. A third dimension 124 (shown in broken line) defines a width of the top channel 106.

A portion of the first wall 118 may be offset from a side of the rear panel 36. More specifically, the first wall 118 may have a first section 126 and a second section 128. The first section 126 connects the rear panel 36 and the second section 128. The first section 126 is about perpendicular to the rear panel 36. The second section 128 connects the first section 126 and the rounded tip 122 and the second section 128 is slanted or extends diagonally relative to the rear panel 36.

In one example, the offset of the first wall 118 from the rear panel 36 may be sufficiently large to accept the barrel portion 56, the complementary barrel portion 60 and the pin 50 of the hinge 44. By positioning the above-described components of the hinge 44 in the offset between the first wall 118 and rear panel 36, the hinge 44 may be mounted flush with the rear panel 36 of the panels 12. Moreover, the hinge 44, in the above-described position, may be protected from exposure to the elements, when the overhead door 10 is in the closed or stacked condition 18 (FIG. 2).

Figure 5:
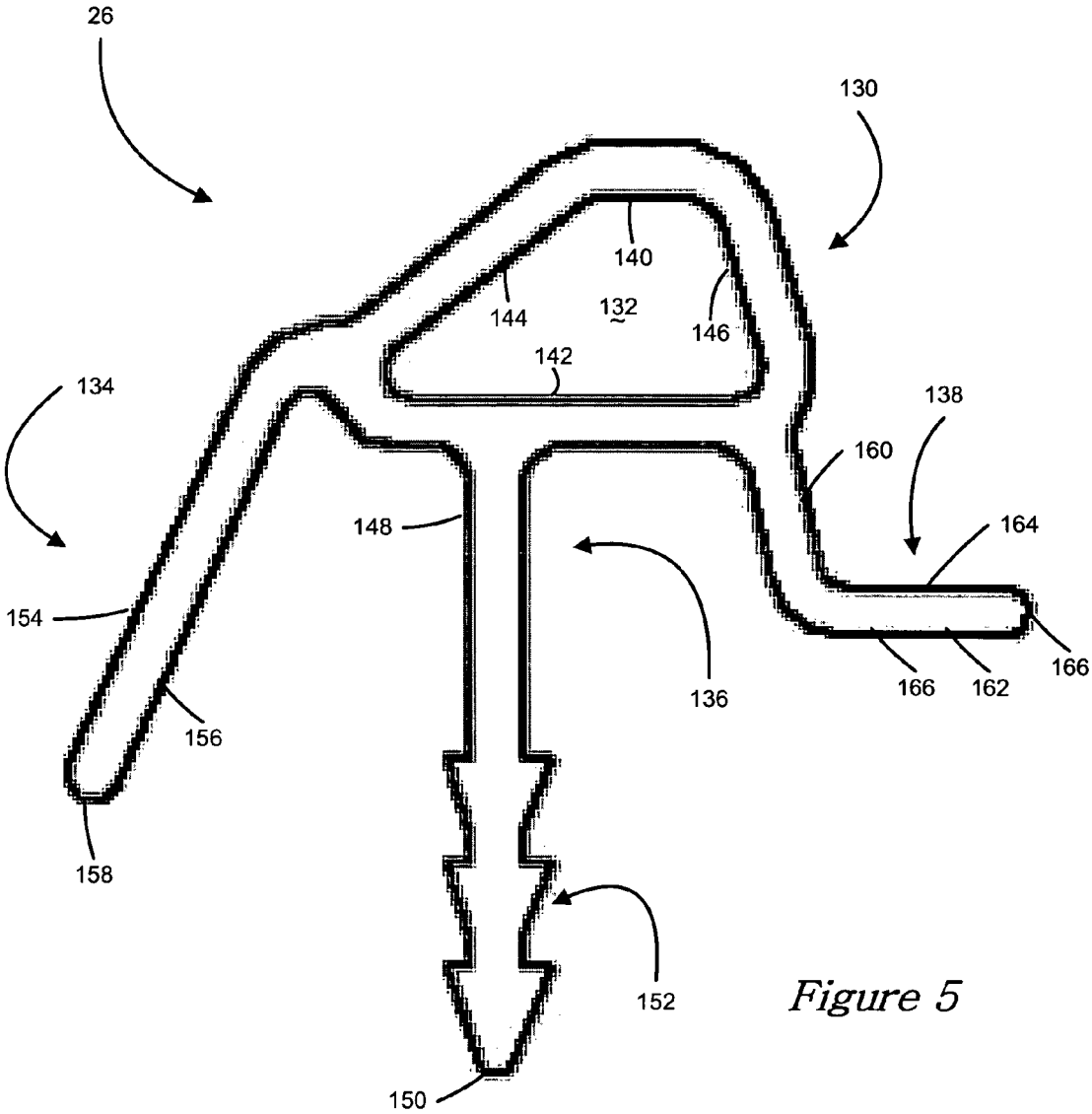
FIG. 5 is a cross-section view of a blocking member in accordance with the present teachings.

With reference to FIG. 5, the blocking member 26 includes a plurality of walls 130 that define a tunnel 132. The blocking member 26 also includes a ramp portion 134, a plug portion 136 and a flange portion 138. The plurality of walls 130 include a top wall 140 connected to a bottom wall 142 by a first side wall 144 and a second side wall 146. The plug portion 136 includes a shaft 148, a tip 150 of the shaft 148 and one or more barb sections 152 extending from the shaft 148. The plug portion 136 may be inserted into the top channel 106 of the top section 38 and engage the inner material 32 of the panel 12. The barb sections 152 may prevent (or make more difficult) removal of the plug portion 136 from the inner material 32. In one example, the plug portion 136 may be omitted. The blocking member 26 may connected to the panel 12 with various suitable connectors such as adhesive or fasteners. In a further example, the blocking member 26 may be integrally formed with the panel 12.

The blocking member 26 may be made of various suitable materials and may be made of a unitary construction. In example, the blocking member 26 is made of a single piece of rigid poly vinyl chloride. It will be appreciated that the blocking member 26, the panels 12 and the various components thereof, while illustrated in cross-section views, may extend over the entire width (or a portion thereof) of the panels 12.

The ramp portion 134 extends from one or more of the plurality of walls 130. In one example, the ramp portion 134 extends from the intersection of the first side wall 144 and the bottom wall 142. The ramp portion 134 includes a first side 154, a second side 156 and terminates in a tip 158. The second side 156 abuts or is slightly spaced from the first wall 108 of the top section 38. As such, the first top portion 102 of the top section 38 is positioned between the ramp portion 134 and the top channel 106. In one example, the tip 158 of the ramp portion 134 is spaced farther from the shaft 148 of the plug portion 136 relative to a section of the ramp portion 134 that connects with the plurality of walls 130.

The flange portion 138 extends from one or more of the plurality of walls 130. In one example, the flange portion 138 extends from the intersection of the second side wall 146 and the bottom wall 142. The flange portion 138 includes a first section 160 that connects a second section 162 to the plurality of walls 130. Both the first section 160 and the second section 162 of the flange portion 138 include a first side 164 and a second side 166. The second section 162 terminates in a tip 168. In one example, the second bottom portion 66 of the bottom section 40 abuts the flange portion 138 of the blocking member 26 when the overhead door 10 is in the closed or stacked position 18 (FIG. 2). More specifically, the rounded tip 86 of the second bottom portion comes into contact with at least the first side 164 of the second section 160 of the flange portion 138. It will be appreciated that the second bottom portion 66 of the bottom portion 40 may abut other portions of the blocking member 26 as the overhead door moves between the open condition 16 and the closed condition 18 (FIG. 2). In one example, the tip 168 of the flange portion 138 is spaced farther from the shaft 148 of the plug portion 136 relative to the first section 160 of the flange portion 138 that connects with the plurality of walls 130.

In one example, the seal block 100 positioned in the second bottom channel 96 of the bottom section 40 may contact the blocking member 26 when the overhead door 10 is in the closed condition 18. More specifically, the seal block 100 may secure to the bottom section 40 of the panel 12 with an adhesive, one or more mechanical fastener and/or other suitable connectors. The seal block 100, therefore, travels with the bottom section 40 as it moves relative to the top section 38 (i.e., between the open condition 16 and the closed condition 18). By way of the above example, the seal block 100 abuts the top wall 140 of the blocking member 26 when the overhead door 10 is in (or approaches) the closed condition 18 (FIG. 2). The contact between the seal block 100 and the blocking member 26 may provide, among other things, a weather seal between the front panel 34 and the rear panel 36.

Figure 6:
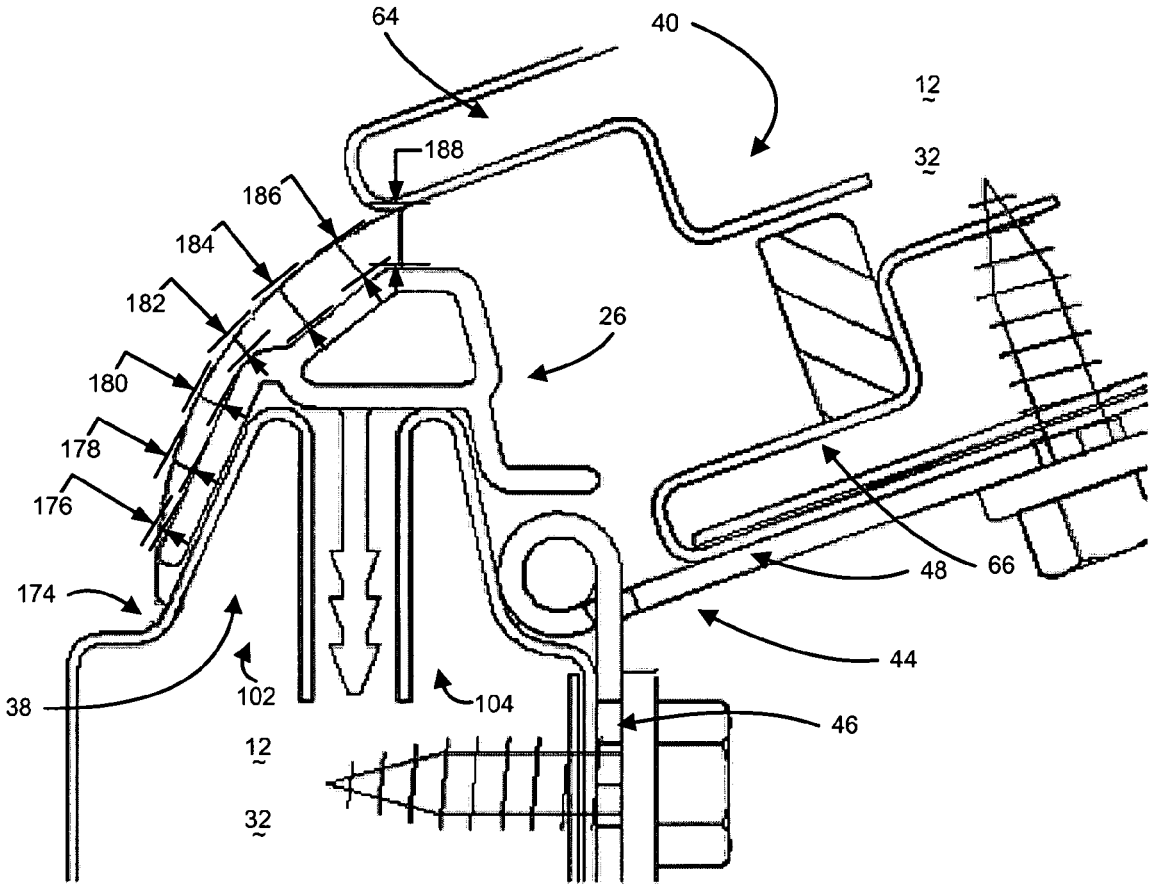
FIG. 6 is similar to FIG. 4 and shows incremental distances between a first door panel and a second door panel.

In one example and with reference to FIG. 6, the adjacent panels 12 are sufficiently close to one another and/or the blocking member 26 to prevent insertion of a human finger, pinch a person and/or other body parts or objects between the panels 12. More specifically, the first bottom portion 64 is sufficiently close to the blocking member 26 as the overhead door 10 moves between the open condition 16 and the closed condition 18. In a further example, a dimension 170 defining a distance of an opening 172 between opposing adjacent panels 12 is less than about 5/32 of an inch (about 3.9 millimeters) throughout the travel of the overhead door 10. By way of the above example, the dimension 170 may be defined as being between the first bottom portion 64 and the blocking member 26 throughout the travel of the overhead door 10 the dimension is less than about 5/32 of an inch (about 3.9 millimeters).

In one example, the adjacent panels 12 are sufficiently close to one another because the dimension 170 of the opening 172 is defined at the following positions or stations between the open condition 16 and the closed condition 18.

TABLE 1

| Stations (Reference Numerals) | Opening Dimension (inches) | Degree of Rotation (degrees) |
|---|---|---|
| 174 | about 0 inches | about 0 |
| 176 | about 0.026 | about 10 |
| 178 | about 0.065 | about 20 |
| 180 | about 0.073 | about 30 |
| 182 | about 0.066 | about 40 |
| 184 | about 0.136 | about 50 |
| 186 | about 0.135 | about 60 |
| 188 | about 0.155 | about 70 |

Per above Table 1, the opening 172 is defined at each station 174-188, which corresponds to a degree of rotation. At station 180, for example, the opening 172 between the adjacent panels is about 0.073 inches (about 1.85 millimeters) and there is about thirty degrees of rotation between the adjacent panels 12. By way of the above example, the first bottom portion 64 is spaced about 0.073 inches (about 1.85 millimeters) from the ramp portion 134 of the blocking member 26. At station 184, for example, the opening 172 between the adjacent panels is about 0.136 inches (about 3.45 millimeters) and there is about fifty degrees of rotation between the adjacent panels 12. By way of the above example, the first bottom portion 64 is spaced about 0.136 inches (about 3.45 millimeters) from the ramp portion 134 of the blocking member 26.

Figure 7A:
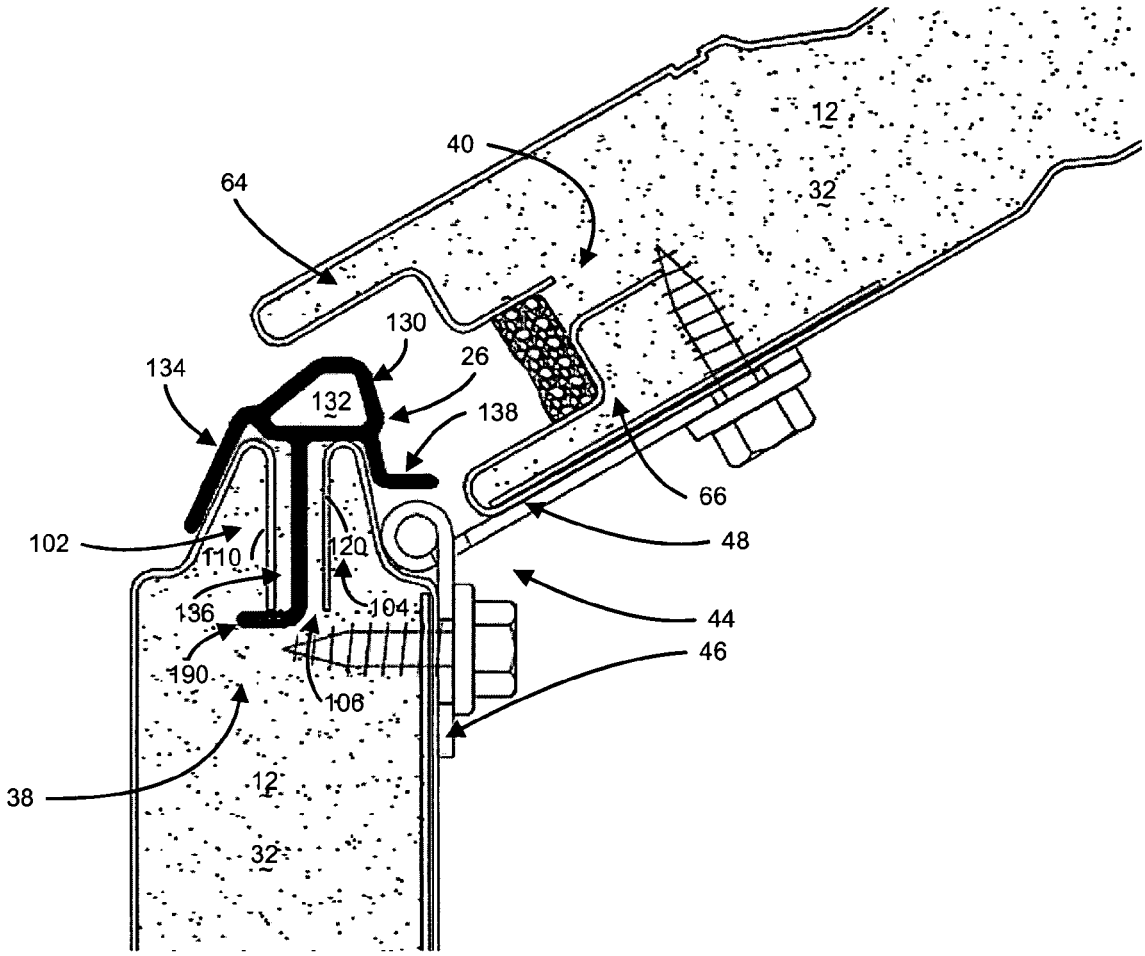
FIGS. 7A-7C are each similar to FIG. 4 and each show alternative blocking members in accordance with the present teachings.

In one example and with reference to FIG. 7A, the blocking member 26 may include a hook portion 190 formed from the plug portion 136. The hook portion 190 may hook around the second wall of the first top portion and/or the second wall 120 of the second top portion 104. In one example, the plug portion 136 may have two hook portions 190 that may collapse when inserted through the top channel 106 and then spread after insertion therein to further secure the blocking member 26 to the panel 12.

Figure 7B:
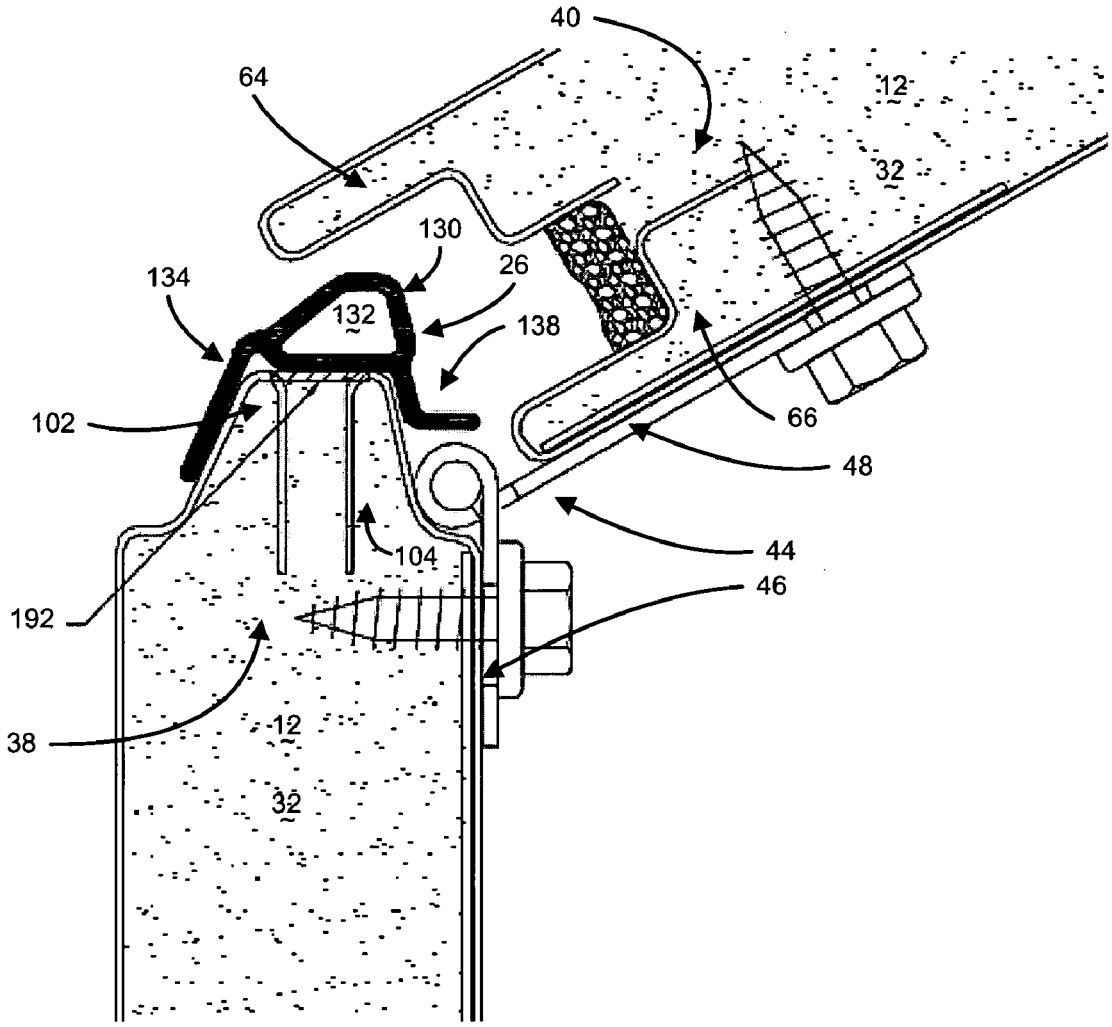
Figure 7C:
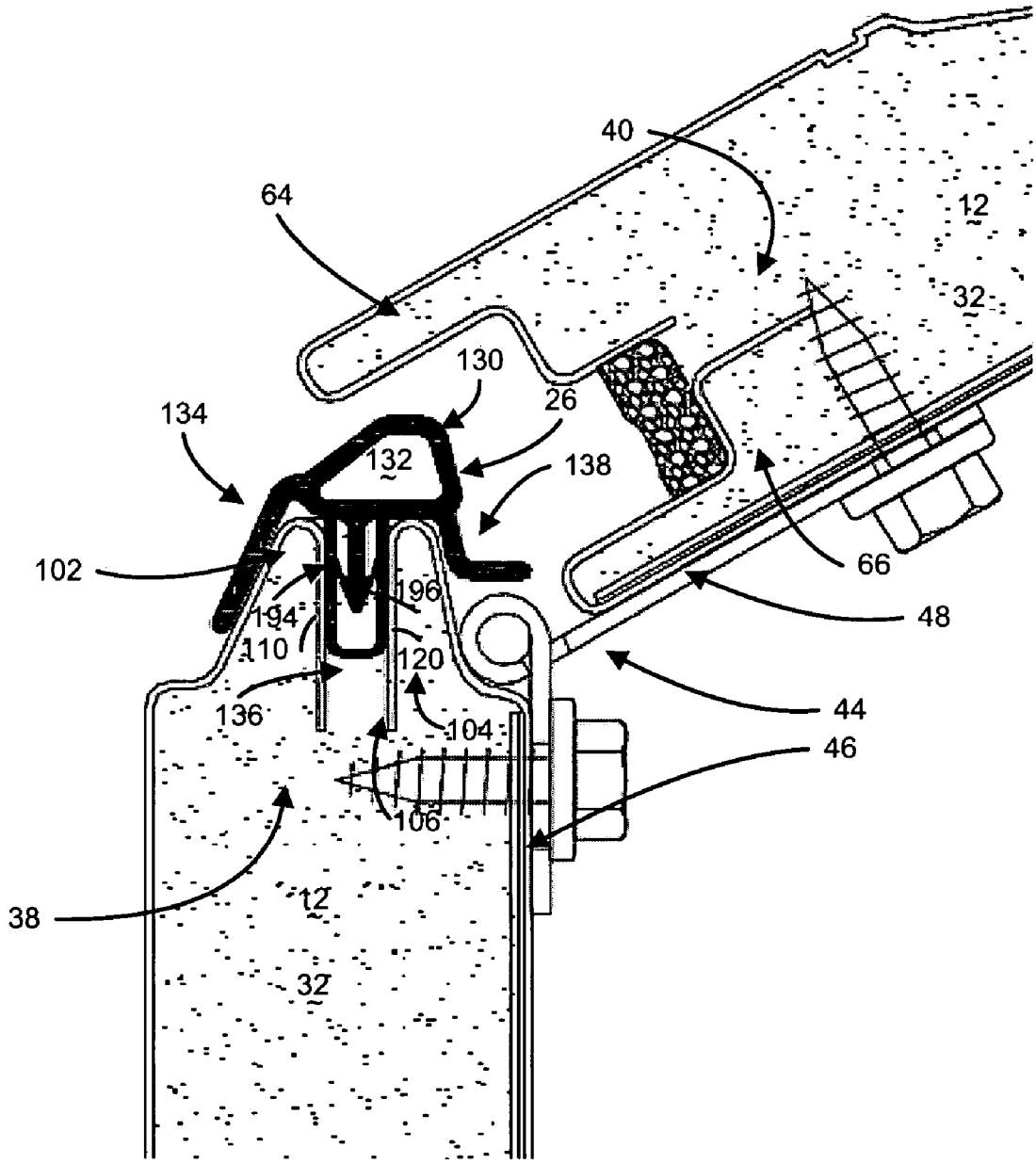

In one example and with reference to FIG. 7B, the blocking member 26 may omit the plug portion 136. The blocking member 26 may connect to the first top portion 102 and/or the second top portion 104 with a suitable adhesive 192 and/or other suitable fasteners. In one example and with reference to FIG. 7C, the plug portion 136 may form a post 194 having one or more internal spring members 196. When the post 194 is inserted into the top channel 106, the post 194 may compress such that the one or spring members 196 may exert a force against the top channel 106. By exerting a force against the top channel 106, the blocking member 26 is further secured to the panel 12.

Those skilled in the art can now appreciate from the foregoing description that the present teachings may be implemented in a variety of forms. Therefore, while the teachings have been described in connection with particular examples thereof, the true scope of the teachings should not be so limited because other modifications will become apparent to the practitioner upon a study of the drawings, the specification and the following claims.

What is claimed is:

1. An articulating door comprising:

a first door panel having a bottom section, said bottom section defining a first bottom portion, a second bottom portion and a first bottom channel between said first bottom portion and said second bottom portion;

a second door panel having a projecting top section defined by a first and second wall spaced inward from respective panel parallel side walls, said first and second walls converging to define an apex at their free ends, said first door panel stackable on said second door panel such that said projecting top section extends into said first bottom channel and said second door panel coupled for rotation with said first door panel, said first door panel and said second door panel moving between an open condition and a closed stackable condition; and a blocking member having a ramp portion, bottom wall, and a top wall, said blocking member extending from said projecting top section of said second door panel such that said top wall defines a terminus of the apex end of the second door panel, wherein at least a portion of said blocking member is received in said first bottom channel of said first door panel in said closed stackable condition, said ramp member extending in a cantilever fashion from said blocking member such that said ramp member abuts said first wall of said top section and covering a portion of said first wall of said top section, said ramp member disposed between said first bottom portion of said first door panel and said projecting top section of said second door panel such that said ramp member is exposed from inside said first bottom channel as said first and second door panels are moved from said stacked closed condition into said open condition and in said open condition said top wall is spaced from and not in contact with said first door panel, said bottom wall covering said apex of said projecting top section.

2. The articulating door of claim 1 further comprising a hinge that includes a first hinge member that connects a first door panel to a barrel portion, a second hinge member that connects a second door panel to a complementary barrel portion and a pin that couples for rotation said barrel portion and said complementary barrel portion and wherein said barrel portion and said complementary barrel portion are disposed behind said first hinge member and said second hinge member such that said hinge is mounted substantially flush with a rear panel of said first door panel and said second door panel.

3. The articulating door of claim 1 wherein said blocking member includes a plurality of walls that define a tunnel.

4. The articulating door of claim 1 wherein said blocking member defines a first sidewall not parallel to a second sidewall.

5. The articulating door of claim 1 wherein said blocking member defines a front sidewall and a bottom sidewall, said ramp portion extends from about the intersection of said front sidewall and said bottom wall.

6. The articulating door of claim 1 wherein said blocking member includes a plug portion that extends from said bottom wall, said plug portion connected to said top section of said second door.

7. The articulating door of claim 6 wherein said plug portion includes at least one of a barb section, a hook portion, a post having internal spring members, and combinations thereof.

8. The articulating door of claim 1 wherein said blocking member defines a flange portion, said ramp portion and a space therebetween, said flange portion and said ramp portion receive said top section of said second door in said space.

9. The articulating door of claim 1 wherein said first bottom portion and said second bottom portion define a second bottom channel that is narrower than said first bottom channel.

10. The articulating door of claim 1 further comprising a seal block connected to said bottom section of said first door, said seal block contacts at least a portion of said blocking member when said first door panel and said second door panel are in said closed condition.

11. An articulating door comprising:

a first door panel having a bottom section including a channel;

a second door panel having a projecting top section defined by a first and second wall spaced inward from respective panel parallel side walls, said first and second walls converging to define an apex at their free ends, said first door panel stackable on said second door panel such that said projecting top section extends into said first bottom channel and said second door panel coupled for rotation with said first door panel, said first door panel and said second door panel moving between an open condition and a closed stacked condition; and a blocking member defining a tunnel having a ramp portion, bottom wall, and a top wall, said blocking member extending from said projecting top section of said second door panel such that said top wall defines a terminus of the apex of the second door panel, wherein at least a portion of said blocking member is received in said first bottom channel of said first door panel in said closed condition, said ramp member extending in a cantilever fashion from said blocking member such that said ramp member abuts said first wall of said top section covering a portion of said first wall of said top section, said bottom wall covering said apex of said projecting top portion and wherein said bottom section of said first door panel is spaced a dimension defining a distance from said blocking member and wherein said distance is less than 5/32 of inch when said first door panel and said second door panel are in said open condition, said closed condition and a plurality of positions therebetween, said bottom wall covering said apex of said projecting top section.

12. The articulating door of claim 11 further comprising a ramp member that extends from said plurality of walls.

13. A method of opening and closing an overhead door comprising:

opening a first panel stacked relative to a second panel such that a portion of said second panel projects into a channel of said first panel, said panels having parallel side walls, said second door panel having a projecting top section defined by a first and second wall spaced inward from respective panel parallel side walls, said first and second walls converging to define an apex at their free ends;

providing a blocking member defining a closed tunnel and including a top wall, a bottom wall and an extending ramp, said ramp member extending in a cantilever fashion from said blocking member such that said ramp member abuts said first wall of said top section covering said first wall, said bottom wall covering the apex of the top section, said blocking member coupled to said second panel and sandwiched in said channel between said first panel and second panel, said bottom wall covering said apex of said projecting top section; and maintaining a distance between said first panel and said blocking member when said first panel is moved with respect to said first panel from a stacked closed condition to an articulated open position, wherein said distance is less than about 5/32 of an inch.

14. The method of claim 13 wherein opening said first panel relative to said second panel includes opening said first panel about ten degrees from said second panel and wherein said distance is less than or equal to about 0.026 inches.

15. The method of claim 13 wherein opening said first panel relative to said second panel includes opening said first panel one of about twenty degrees and about forty degrees from said second panel and wherein said distance is less than or equal to about 0.066 inches.

16. The method of claim 13 wherein opening said first panel relative to said second panel includes opening said first panel about thirty degrees from said second panel and wherein said distance is less than or equal to about 0.073 inches.

17. The method of claim 13 wherein opening said first panel relative to said second panel includes opening said first panel one of about fifty degrees and about sixty degrees and wherein said distance is less than or equal to about 0.136 inches.

18. The method of claim 13 wherein opening said first panel relative to said second panel includes opening said first panel about seventy degrees from said second panel and wherein said distance is less than or equal to about 5/32 of an inch.

* * * * *